US005502452A

United States Patent [19]

Gomez

[11] Patent Number: 5,502,452

[45] Date of Patent: Mar. 26, 1996

[54] UNIVERSAL MOUNTING SYSTEM FOR MOBILE TELECOMMUNICATIONS ANTENNAS

[75] Inventor: Francisco X. Gomez, Oak Park, Ill.

[73] Assignee: The Antenna Company, Itasca, Ill.

[21] Appl. No.: 274,494

[22] Filed: Jul. 13, 1994

[51] Int. Cl.[6] ..... H01Q 1/32; H01Q 1/50

[52] U.S. Cl. ..... 343/715; 343/872; 343/906

[58] Field of Search ..... 343/711, 713, 343/715, 872, 873, 887, 888, 900, 906; H01Q 2/12, 1/32

[56] References Cited

U.S. PATENT DOCUMENTS

| | | | |
|---|---|---|---|
| 4,021,809 | 5/1977 | Klancnik | 343/715 |
| 4,186,401 | 1/1980 | Altmayer | 343/715 |
| 4,360,814 | 11/1982 | Wells | 343/715 |
| 4,872,017 | 10/1989 | White | 343/715 |
| 5,015,194 | 5/1991 | Seas | 439/314 |
| 5,157,410 | 10/1992 | Konishi | 343/715 |
| 5,248,986 | 9/1993 | Marshall | 343/715 |

*Primary Examiner*—Donald T. Hajec
*Assistant Examiner*—Tan Ho
*Attorney, Agent, or Firm*—Lockwood Alex FitzGibbon & Cummings

[57] ABSTRACT

A self-adjusting antenna mounting assembly includes a protective base cap member which engages a vehicle antenna base and a contact extension cartridge. The contact cartridge includes a spring-biased hollow contact sleeve which biases the contact sleeve within a cavity so that it adjusts for varying lengths of contact pins which it engages. The contact sleeve has multiple arc-like segments which permit it to engage a contact pin of the antenna base, while not transferring any forces to it during installation.

22 Claims, 2 Drawing Sheets

UNIVERSAL MOUNTING SYSTEM FOR MOBILE TELECOMMUNICATIONS ANTENNAS

BACKGROUND AND SUMMARY OF THE INVENTION

The present invention is directed generally to mobile telecommunications antenna mounting assemblies, and more specifically to a self-adjusting mobile telephone antenna mounting assembly which has a construction which reduces the likelihood of transfer of detrimental forces to the internal circuitry of the mounting assembly which may occur during installation of the assembly and antenna radiating element.

The number of mobile telephones in use in vehicles has risen dramatically in the past years and continues to increase. Many of these mobile telephones rely upon an antenna assembly mounted to the vehicle body. Often, the antenna assembly extends through an opening in the vehicle body and utilizes a portion of the vehicle body as a ground plane extension to enhance the ability of the antenna to receive and radiate radio frequency waves. The assembly typically includes an internal module mounted to the inside surface of the vehicle body and an external component which may extend through an opening cut in the vehicle body to engage the internal module. A cable extends between the vehicle mobile telephone and the internal module to connect them together.

These style mounting assemblies usually rely upon a cylindrical contact pin to connect the radiating element to the internal module. This contact pin extends up from the internal module through a protective cap to rigidly connect to the radiating element. These rigid connections are not easily adjustable and often may not compensate for the varying thicknesses encountered with different vehicle body panel portions. With such connections, the installation of either the protective base cap or radiating element may force the contact pin against the internal module and its associated internal circuitry, thereby increasing the likelihood of compromising the internal connections therebetween.

The present invention is directed to a mobile telecommunications antenna mounting assembly which overcomes the aforementioned disadvantages and which self-adjusts to the thickness of a vehicle mounting surface. It avoids the transfer of detrimental forces produced during installation to the internal circuitry of the internal antenna module and easily accommodates many standard antenna bases which use a central contact pin.

The antenna mounting assembly of the present invention comprises an external base and a protective base cap. The base cap includes a contact pin extension subassembly which may take the form of a cartridge-type assembly that extends through the base cap to provide an internal, self-compensating connection between the base contact pin and the antenna radiating element. The contact pin extension includes a biasing spring which extends within a recess of the pin body member and biases a circular collar, or hollow receptacle, axially outwardly from the body of the contact pin extension.

Inasmuch as vehicle body thicknesses vary between different makes and models of vehicles, the biasing spring permits selective axial movement of the contact collar to adjust for the distance which the base contact pin may project outwardly because of the vehicle body panel thickness. The contact pin extension engages the base cap so that the pin body member and base cap act as one component during installation. Accordingly, when the base cap is installed, there is no transfer of any twisting forces to the internal module circuitry of the antenna assembly because the contact receptacle freely spins while engaging the internal contact pin member.

Accordingly, it is a general object of the present invention to provide a universal mounting assembly for a mobile telecommunications antenna which self-adjusts for varying thickness of the vehicle body panels.

Another object of the present invention is to provide a mobile telecommunications antenna mounting apparatus having a spring-biased contact pin extension cartridge which rotatively engages the internal module contact pin to thereby eliminate the transfer of any detrimental forces to the contact pin during installation of the apparatus.

A further object of the present invention is to provide an improved universal pin mounting apparatus for a mobile telecommunications antenna which includes an external protective base cap having a cylindrical contact element extending axially through the base cap, the contact element having a cavity therein which houses a coil spring and a hollow contact sleeve, the contact sleeve being in rotatable contact with a rigid contact pin disposed in a base portion, the hollow sleeve element being axially biased within the contact element by the coil spring, whereby the spring permits the contact collar to displace within the cylindrical member cavity when engaged by a central contact pin of the antenna mounting base.

A still further object of the present invention is to provide a kit of parts for use in the assembly of a mobile telecommunications mounting assembly having an external base cap adapted to engage a base member which projects out from an opening in a vehicle body, the kit of parts including a contact pin body extension, a spring engaging the extension member and a contact sleeve slidably engaging the extension and spring, the extension member further engaging the base cap when installed such that the base cap and extension member rotate together as one component, whereby the spring permits self-adjustment of the extension member by movement of the contact receptacle along the pin body axis during installation.

These and other objects, features and advantages of the present invention will become apparent from the following detailed description, taken in conjunction with the accompanying drawings, wherein like reference numerals refer to like parts.

BRIEF DESCRIPTION OF THE DRAWINGS

In the course of this detailed description, reference will be made to the attached drawings in which.

DETAILED DESCRIPTION OF THE INVENTION

Figures 1, 2, 3:
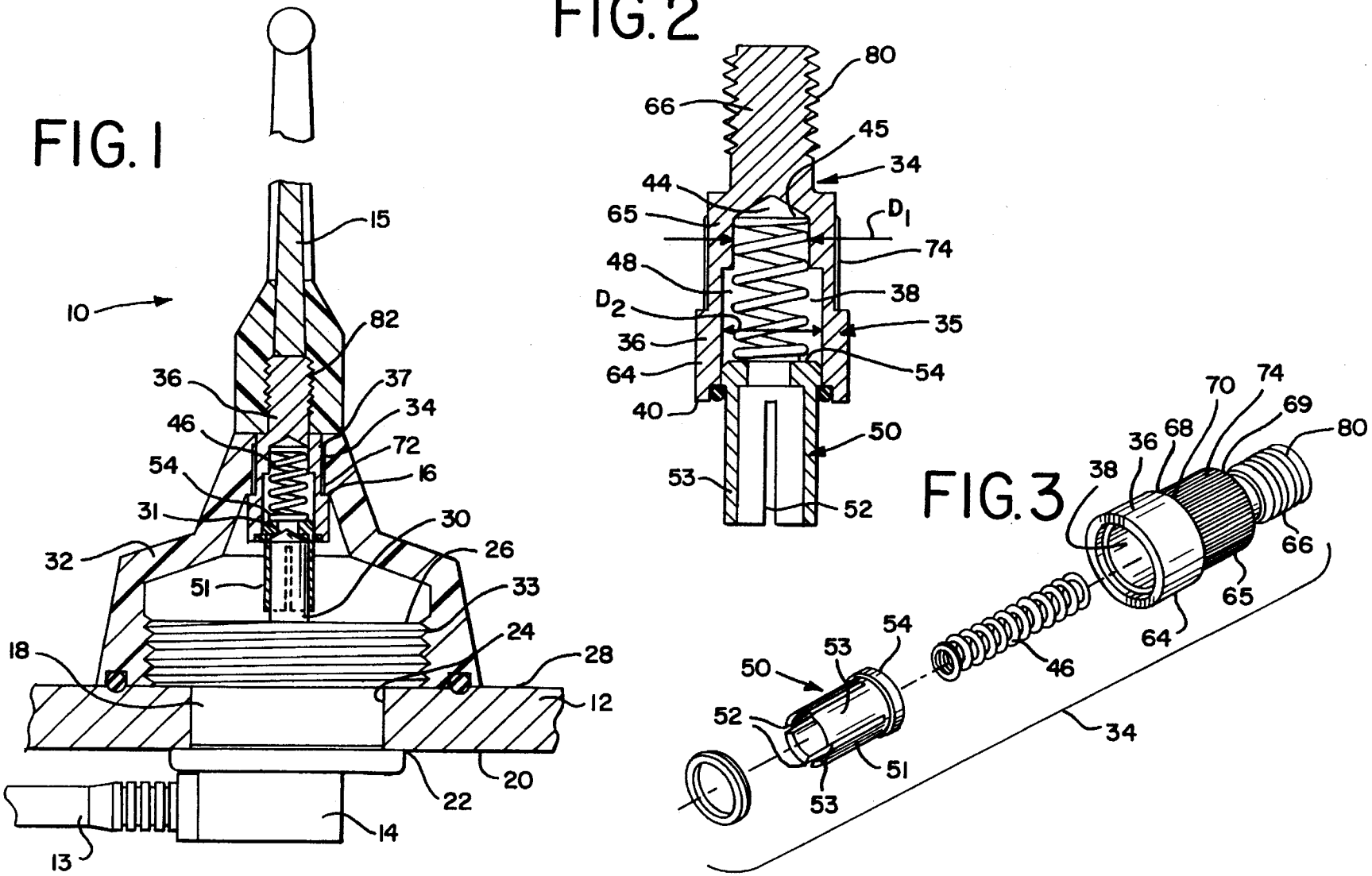
FIG. 1 is a sectional view of a mobile telecommunications antenna assembly constructed in accordance with the principles of the present invention.
FIG. 2 is a sectional view of the contact pin subassembly of the antenna mounting assembly of FIG. 1.
FIG. 3 is an exploded perspective view of the contact pin subassembly of FIG. 2.

Referring now to the drawings, and particularly FIG. 1, a preferred embodiment is illustrated of a mobile telecommunications antenna apparatus 10 constructed in accordance with the principles of the present invention. The apparatus 10 is shown mounted in place on the body panel 12 of a vehicle. This panel 12 which may include a horizontal portion of the roof or a relatively vertical portion of a sidewall of the vehicle. The orientation of the body panel 12 does not affect the operation or benefits of the present invention.

A coupling unit 14 which contains the appropriate electronic circuitry such as a radiating circuit and an impedance matching circuit which permits the maximum high frequency energy to be radiated or absorbed by the radiating external radiating antenna element 15. A cable assembly 13 extends between the mobile telephone unit (not shown) of the vehicle and the coupling unit 14 mounted inside of the vehicle. The coupling unit 14 may be attached to the interior surface 20 of the vehicle body panel 12 for example, by a layer of adhesive disposed on a contact pad 22 of the unit 14 which opposes the body panel 12, so that the coupling unit 14 engages an opening 18 cut in the body panel 12.

A retaining means, illustrated as a ring element 24 may partially extend through the body panel opening 18 and may engage the coupling unit 14 in a manner well known in the art to retain the coupling unit 14 in place upon the body panel 12 so as to provide a sturdy base portion 26 for the apparatus. The base portion 26 projects past the exterior surface 28 of the vehicle body panel 12 and is engaged by the ring element 24 and is further engaged by a protective base cap 32 which may be threaded onto the base 26. In an alternate construction, the internal coupling unit 14 may extend through the body panel opening 18 and may be equipped with a threaded engagement portion 33 to provide a base for engagement by the base cap 32.

Regardless of the construction of the base portion 26, it typically includes an electrical contact member, such as a cylindrical contact pin 30 which extends from the base portion 26 and provides a means of operative electrical connection between the radiating element 15 and the internal circuitry of the coupling unit 14. The contact pin 30 is held within the base portion 26 in the general central portion of the base portion 26 and extends outwardly therefrom away from the body panel 16. The base cap 32 engages the base portion 26 at the threaded portion 33 to protect the contact pin 30 from atmospheric elements.

In an important aspect of the present invention, a contact pin extension, or assembly 34, provides an electrical connection between the radiating element 15 and the contact pin 30. FIGS. 2 and 3 best illustrate the details of this contact pin extension 34. The extension assembly 34 takes the form of a cartridge 35 which includes a cylindrical cartridge body 36 having a central cavity 38 extending axially therewithin from the rear end 40 of the cartridge body 36. The cavity 38 is shown as having two portions of different diameters $D_1$, $D_2$ which are separated by an inner, annular shoulder 42. The first cavity portion 44 is the smaller of the two and is disposed entirely within the cartridge body 36, while the second portion 48 is the larger of the two and is disposed at the rear end 40 of the body 36.

A means for selectively biasing an engagement member 50 of the extension assembly 34 is illustrated as a coil spring 46 and extends through the cavity 38 and bears against a forward edge 45 of the cavity 38 at one end of the coil spring 46. The other end of the coil spring 46 bears against the contact pin extension assembly engagement member 50, shown as a hollow contact sleeve 51 which establishes an electrical connection between the antenna base portion contact pin 30 and the radiating element 15. In this regard, the coil spring 46, contact sleeve 51 and extension assembly body 36 may all be preferably formed from an electrically conductive material so that all three of these components form a conductive path from the antenna base contact pin 30 to the radiating element 15.

The contact sleeve 51 may contain one or a plurality of longitudinal slots 52 which separate the sleeve into multiple arcuate segments 53 which slightly flex outwardly, if necessary, to accommodate contact pins 30 which may have a slightly greater diameter slightly greater than that of the sleeve 50, but still maintain the contact sleeve segments 53 in touch with the contact pin 30 to maintain an electrical connection therebetween. The slots 52 also facilitate rotation of the contact sleeve 51 on the contact pin 30 when the entire assembly is installed in place upon the antenna base portion 26 by way of the ability of the sleeve segments 53 to flex. The contact sleeve 50 is free to rotate in place on the contact pin 30, and there is virtually no likelihood of the transfer of twisting forces to the internal circuitry of the antenna assembly because the contact sleeve 50 does not engage the contact pin in a rigid manner and because the contact sleeve 50 and the base cap 26 rotate together as one during installation.

The coil spring 46 provides a self-adjusting means for the assembly 10 in that the contact sleeve 51 has a spring engagement surface 54 disposed on its forward end 55 within the extension assembly 34. The engagement surface 54 bears against the rear end **47*a* of the coil spring 46. The contact sleeve 51 is preferably held in place within the cavity 38 by a suitable retainer, such as the elastomeric ring 56 which resides in an annular channel 57. This retainer 56 limits the reciprocating movement of the contact receptacle 50 within the cavity 38. The coil spring 46 applies an outward biasing force to the contact sleeve 51 and permits it to reciprocate within the cavity 38 in response to the forward end 31 of the base contact pin 30** impinging upon it to give the present invention its desired self-adjusting characteristics.

The cartridge body 36 is generally cylindrical and has three portions 64, 65 & 66 defined in its outer surface by two circumferential shoulders 68, 69 formed therein. The first shoulder portion 68 is located near the rear of the cartridge body 36 and preferably forms a stop surface 70 which engages a similarly formed inner shoulder 72 of the base cap 32 and prevents the contact pin extension assembly 34 from being pushed through the base cap passage 37 during assembly. It also aligns the third body portion 66 with the base cap 32 to define a seat 16 against which the radiating element 15 sits when the assembly installation is completed.

The second body portion 65 is positioned between the other two portions 64, 66 and is provided to firmly engage the base cap passage 37. It includes a series of engagement members, shown as knurls 74, that extend radially outwardly from the outer surface thereof of the body portion 65. These knurls 74 cooperate with the base cap 32 and firmly engage the inner surface of the base cap passage 37 to provide an interference fit therebetween so that the extension assembly 34 and the base cap 32 operate as one element when they are assembled into the antenna base 26. The third body portion 66 is disposed forward of the second body portion 65 and includes a threaded cylindrical, outer surface 80 which engages a complimentary threaded bore 82 of the antenna radiating element 15.

The structure of the invention provides certain benefits and advantages as explained hereinafter. The coil spring 46 may be compressed in the cartridge body cavity 38 by the contact pin 30 of an antenna base 26 and therefore automatically adjusts to the thicknesses of the vehicle body panel 16. The outer diameter of the contact sleeve forward end 54 is approximately equal to that of the inner surface of the cartridge body cavity 38 so that an electrically conductive relationship is established between the contact sleeve 51 and the cartridge body 36. This electrically conductive relationship may be further enhanced by making the spring 46 from a conductive material to establish an additional conductive path between the cartridge body 36 and the contact sleeve 51.

The contact sleeve 51 slides over and maintains an electrical contact with the contact pin 30 regardless of body panel thickness because the contact sleeve 51 has a length sufficient to engage the contact pin 30 to accommodate situations where the contact pin 30 does not enter the cartridge body cavity 38 and also moves within the cavity to accommodate situations where the contact pin 30 enters the cartridge body cavity 38.

Figure 4:
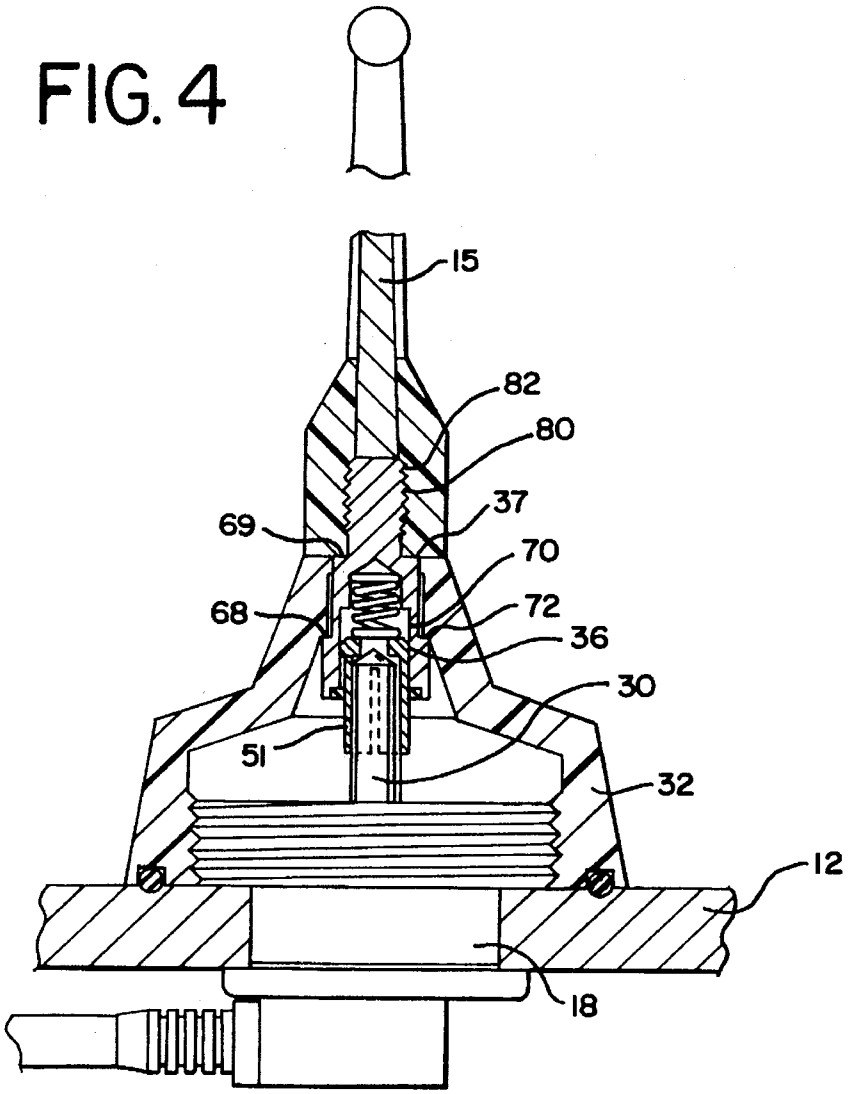
FIG. 4 is a sectional view of the mounting assembly of FIG. 1, in a condition where the vehicle body has a relatively small thickness, and, FIG. 5 is a sectional view of the mounting assembly of FIG. 1 shown installed in place wherein the vehicle body has a relatively large thickness.

FIG. 4 illustrates one condition of benefit to the present invention in place or a vehicle wherein the vehicle body panel 12 has a relatively small thickness. The contact pin 30 may, in this situation extend slightly more from the base portion 26 because of the body panel thickness. In this instance, the forward end 31 of the contact pin 30 extends into the cavity 38 and engages the inner shoulder of the contact sleeve 51 and urges it along into the cartridge body cavity 38. The coil spring 46 resists this contact and maintains the contact sleeve 51 against the antenna base contact pin 30 in a conductive connection, while permitting the sleeve 51 to move axially within the cartridge body cavity 38, while electrical contact is maintained between the contact pin 30 and the contact sleeve 51.

Figure 5:
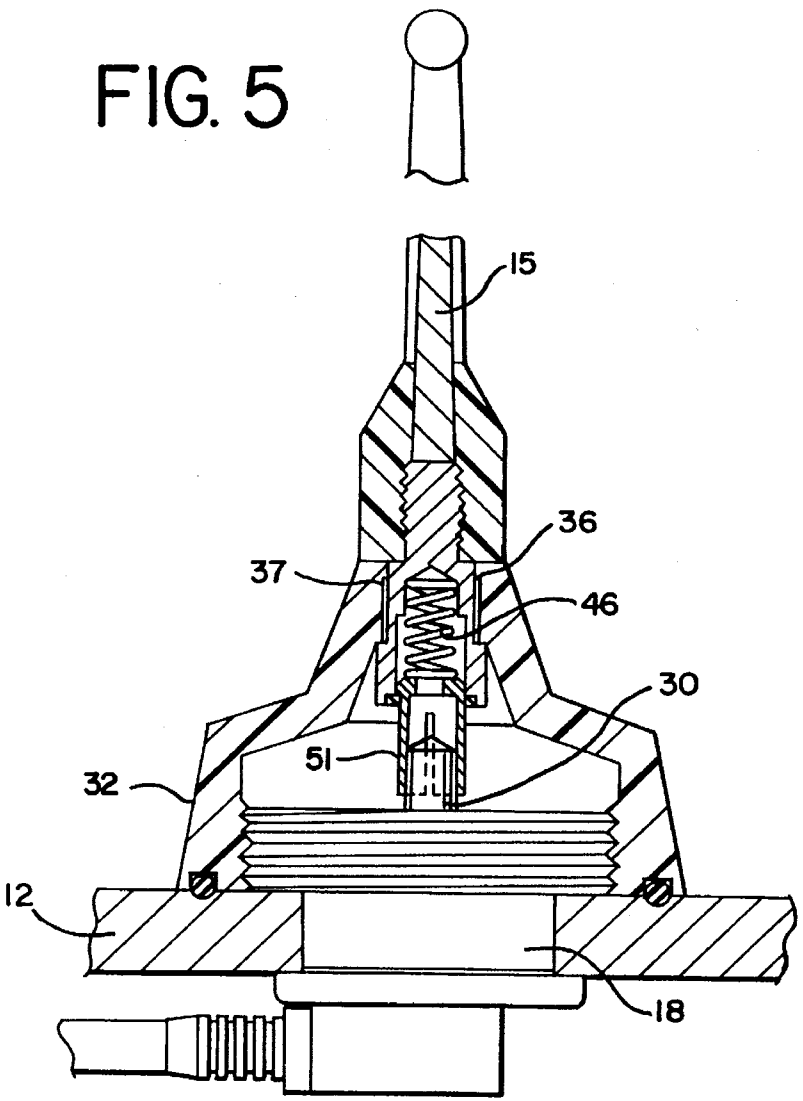

In instances where the vehicle body panel has a relatively larger body panel thickness such as is illustrated in FIG. 5, the contact sleeve 51 extends rearwardly from the cartridge body and will engage a short contact pin 30 in the manner shown in FIG. 5. Because the contact sleeve 51 is formed from an electrically conductive material, a reliable connection is always maintained between the contact sleeve 51 with the antenna base contact pin 30. Thus it can be seen that base cap 32 and contact pin extension assembly 34 cooperate to form an integrated assembly which may be installed upon many different antenna bases without fear that the connection will be undesirable or that the installation will apply any detrimental forces to the internal circuitry of the antenna base 26 and internal coupling unit 14.

While the preferred embodiment of the invention has been shown and described, it will be understood by those skilled in the art that changes or modifications may be made thereto without departing from the true spirit and scope of the invention.

I claim:

1. In an external antenna mounting assembly for a mobile telecommunication unit of a vehicle, the antenna mounting assembly including an antenna radiating element, an antenna base element which extends through an opening of the vehicle, the antenna base element having an electrical contact pin extending therefrom to provide a point of operative electrical connection to the telecommunication unit of said vehicle, the improvement comprising:

an integrated assembly for covering the antenna base element and establishing an operative connection between said antenna base element contact pin and the radiating element, the assembly including a base cap element and a contact pin extension cartridge, the base cap element having means for engaging said antenna base element contact pin, said base cap element having a first passage extending therethrough in alignment with said antenna base element contact pin and a second passage in communication with the first passage, the second passage being larger than said first passage, said contact pin extension cartridge including an elongated body which partially extends within the base cap first passage and firmly engages said base cap element such that said cartridge body and base cap element act as a single component during installation thereof on said antenna base element, said cartridge body including an axial cavity and a hollow contact sleeve disposed in the cavity, said cartridge body further including a spring means disposed in said cavity and in contact with, at opposite ends of the spring means, said contact sleeve and said cartridge body, said contact sleeve rotatably receiving said contact pin in engagement therewith such that a portion of said antenna base element contact pin extends into said contact sleeve when said integrated assembly is installed upon said antenna base element, said contact sleeve extending into said base cap element second passage, said contact sleeve further including a plurality of longitudinal slots which divide said contact sleeve into distinct arcuate segments to thereby facilitate engagement between said antenna base element contact pin and said contact sleeve by permitting said contact sleeve segments to flex outwardly into said base cap element second passage without interference with said base cap element during engagement with said antenna base element contact pin.

2. The improved antenna assembly of claim 1, wherein said cartridge body includes a retainer disposed proximate to said cavity which limits movement of said contact sleeve within said cavity, said contact sleeve further having, at one end thereof, a surface which engages said retainer member during movement of said contact sleeve within said cavity.

3. The improved antenna assembly of claim 2, wherein said spring means is formed from a conductive material.

4. The improved antenna assembly of claim 2, wherein said contact sleeve engagement surface includes an annular shoulder member which engages said cartridge body retainer.

5. The improved antenna assembly of claim 1, wherein said cartridge body includes an engagement portion on its exterior surface which interferingly engages said base cap element, the cartridge body engagement portion including a plurality of surface interruptions which extend outwardly therefrom and engage an opposing engagement surface formed in said base cap element when said cartridge body is inserted into said base cap element, to thereby provide an interference engagement which prevents relative rotation between said cartridge body and said base cap element, whereby said cartridge body and said base cap element rotate as one integral unit.

6. The improved antenna assembly of claim 5, wherein said cartridge body surface interruptions include a plurality of knurls.

7. The improved antenna assembly of claim 1, wherein said cartridge body includes a stop surface which engages said base cap element to a distance which said cartridge body may be inserted into said base cap element first passage.

8. The improved antenna assembly of claim 1, wherein said cartridge body includes a forward threaded end portion adapted to receive the antenna radiating element.

9. A mounting assembly for mounting a mobile telecommunications antenna on a vehicle through an opening formed in a body panel portion of the vehicle, comprising:

a coupling component mounted to an interior surface of said vehicle, the coupling component at least partially extending through the body panel opening; a base component, a contact pin disposed on the base component and extending away from said base component and said body panel opening; means for retaining the base component on said vehicle body panel in registration with said body panel opening; a base cap component which engages said base component and encloses said contact pin from the surrounding environment in a first internal passage thereof; and, an extension component engaging the base cap component and axially aligned with said base component contact pin, the extension component having a hollow body, the extension component hollow body having an axial cavity extending therein, said axial cavity receiving a spring means and hollow contact sleeve therein, the contact sleeve being reciprocatable within said axial cavity in response to contact with said base component contact pin, said contact sleeve member extending into said base cap component first internal passage without contacting said base cap component and being further axially aligned with said base component contact pin and having an inner diameter slightly approximately greater than an outer diameter of said base component contact pin so as to provide an operative electrical connection between said base component contact pin and said contact sleeve yet permitting rotation of said contact sleeve upon said base component contact pin without the transfer thereto of any rotational forces, said extension component hollow body having an interrupted outer surface which interferingly engages said base cap component at a second internal axial passage thereof, whereby said base cap component and contact pin extension components act as one component.

10. The mounting assembly of claim 9, wherein said contact sleeve has at least one longitudinal slot disposed therein which facilitates engagement of said base component contact pin by said contact sleeve by permitting rotation of said contact sleeve upon said base component contact pin and by permitting said contact sleeve to flex slightly outwardly into said base cap component first internal passage without interference with said base cap component, and said spring means including a compression spring which provides an additional electrical connection between said contact sleeve member and said contact pin extension component.

11. The mounting assembly of claim 10, wherein said contact sleeve has a diameter greater than that of said compression spring and said hollow body axial cavity includes first and second subcavities defined therein which are separated by an inner shoulder, the first subcavity receiving a portion of said spring means therein, and the second subcavity receiving a portion of said compression spring and of said contact sleeve, the compression spring extending between said contact sleeve and said hollow body portion to establish an electrical connection therebetween.

12. The antenna mounting assembly of claim 11, wherein said contact sleeve includes a plurality of longitudinal slots extending therein which enhance engagement between said base component contact pin and said contact sleeve yet permit relative rotation between said base component contact pin and said contact sleeve.

13. The antenna mounting assembly of claim 12, wherein said extension component includes means for retaining said contact sleeve in said axial cavity and for limiting the movement of said contact sleeve member within said axial cavity.

14. The mounting assembly of claim 9, wherein said extension component hollow body surface interruptions include a plurality of radially extending knurls.

15. The antenna mounting assembly of claim 9, wherein said extension component includes a threaded front end portion which is adapted to engage an antenna radiating element, and said hollow body extension component includes a stop surface defined thereon which aligns said extension component threaded front end portion with a forward end of said base cap component.

16. An external antenna assembly for mounting a radiating element to a body panel of a vehicle, the radiating element being connected by the assembly to a mobile telecommunications unit inside of the vehicle, the assembly comprising:

a base element which at least partially engages said vehicle body panel, the base element including a contact member extending outwardly therefrom;

a radiating element;

an interconnecting assembly extending between said base element contact member in said radiating element, the interconnecting assembly establishing an electrical connection therebetween in which said interconnecting assembly is free to rotate while engaged with said base element contact member; and, a base cap element having an internal cavity which substantially encloses said interconnecting assembly and said base element contact member to protect them from external environmental forces, the base cap element having means for holding said interconnecting assembly in alignment with said base element contact member, whereby said interconnecting assembly and said base element contact member share a common axis, said interconnecting assembly including an elongated body member, a slotted shell member disposed in an axial recess of the body member and extending into said base cap element internal cavity without interferingly contacting said base cap element, said interconnecting assembly being aligned with said base element contact member, said body member further including spring means disposed in said axial recess and engaging said shell member, the spring means applying a biasing to said shell member and urging said shell member in direction which leads out of said axial recess, said shell member having an internal shoulder which presents a surface which is adapted to engage said base element contact member, whereby said shell member moves longitudinally within said axial recess against said spring means when said shell member shoulder is touched by said base element contact member, said interconnecting assembly holding means including a passage disposed in said base cap element in communication with said base cap element internal cavity and said interconnecting assembly body member including a plurality of radially outwardly extending knurls which engage said base cap element passage in an interference fit, whereby when said base cap element is rotated relative to said base element contact member, said base cap element and said interconnecting assembly body member turn as a unit and wherein said slotted shell member does not transfer any significant twisting forces to said base element contact member nor contact said base cap element.

17. The assembly of claim 16 wherein said interconnecting assembly body member recess includes two recess portions disposed therein, one recess portion having a diameter approximately equal to that of said spring means and the other recess portion having a diameter approximately equal to that of said slotted shell member, said spring means being extending in said two recess portions and said slotted sleeve member being disposed in one of said two recess portions.

18. The assembly of claim 16, wherein said interconnecting assembly body member, slotted shell member and spring means are all formed from an electrically conductive material.

19. The assembly of claim 16, wherein said interconnecting assembly body member includes an annular stop surface which engages an opposing surface of said base cap element to align a forward, radiating element engagement portion of said interconnecting assembly with said base cap element.

20. An assembly for interconnecting an external antenna radiating element to an antenna base element mounted on a body panel of a vehicle by engaging a contact pin disposed in the antenna base element in an electrically conductive manner so as to enable transmittal of radio frequency signals between the radiating element and a mobile telecommunications unit located inside of the vehicle, said interconnecting assembly comprising:

an elongated cartridge body having a cavity extending longitudinally therein for a portion of a length of the cartridge body, a slotted shell member disposed in the cavity, spring means disposed in said cavity between an endwall of said cartridge body and said shell member, the cartridge body endwall defining a forward end of said cavity, said shell member having a forward engagement surface which abuts one end of said spring means and further having an exterior engagement surface in contact with an inner surface of said cartridge body which defines said cavity, the cartridge body further including means for retaining said shell member in said cavity, the shell retaining means further limiting longitudinal movement of said shell member within said cavity, at least said shell member and said cartridge body being formed from a conductive material so as to provide an electrically conductive path from a rearward end of said shell member to a forward end of said cartridge body which interconnects said antenna base element contact pin with said radiating element, the cartridge body forward end including an engagement surface which receives said antenna radiating element in place thereon; and, a base cap having a a first recess extending therethrough which substantially encircles an outer engagement surface of said cartridge body and a second recess in communication with said first recess, the second recess further substantially enclosing said antenna base element contact pin to protect the contact pin and slotted shell member from external environmental forces, the base cap first and second recesses being aligned with said base element contact pin in a coaxial relationship whereby said shell member and said base element contact pin share a common axis, whereby said shell member engages an outer surface of said antenna base element contact pin when said base cap is installed upon said antenna base element to electrically interconnect said antenna base element contact pin to said antenna radiating element, said shell member being capable of rotation on said antenna base element contact pin during said installation, thereby avoiding the transfer of an twisting forces to said antenna base element contact pin, said spring means permitting movement of said shell member within said cartridge body cavity to adjust for different lengths of contact pins disposed in said antenna base element, said shell member further being capable of slight expansion in its engagement with said antenna base element contact pin during installation to thereby permit said shell member to adjust for different diameters of contact pins disposed in said antenna base element.

21. The interconnecting assembly of claim 20, wherein said spring means is formed from an electrically conductive material and said spring means cooperates with said cartridge body and shell member to establish said electrically conductive path.

22. The interconnecting assembly of claim 20, wherein said shell member includes a plurality of longitudinal slots extending therein which enhance engagement between said antenna base element contact pin and said shell member by facilitating rotation of said sleeve member upon said antenna base element contact pin.

* * * * *